US005722905A

United States Patent [19]

Bidelman

[11] Patent Number: 5,722,905

[45] Date of Patent: Mar. 3, 1998

[54] COLLAPSIBLE PITCHING SCREEN ASSEMBLY

[76] Inventor: Patrick Kay Bidelman, 950 Dartmoor Cir., Nokomis, Fla. 34275

[21] Appl. No.: 735,788

[22] Filed: Oct. 21, 1996

[51] Int. Cl.[6] ..... A63B 69/00

[52] U.S. Cl. ..... 473/451; 473/454; 473/197; 473/476; 273/400

[58] Field of Search ..... 273/400, 395, 273/396, 410; 473/197, 421, 456, 454

[56] References Cited

U.S. PATENT DOCUMENTS

| | | | |
|---|---|---|---|
| 2,827,297 | 3/1958 | Foster | 273/410 |
| 3,583,703 | 6/1971 | Brown | 473/456 |
| 4,133,531 | 1/1979 | Arteaga et al. | 273/395 |
| 4,456,251 | 6/1984 | Balaz | 273/395 |
| 5,042,820 | 8/1991 | Ford | 273/395 |
| 5,118,103 | 6/1992 | Miller | 473/197 |
| 5,527,032 | 6/1996 | Colemen et al. | 473/454 |

FOREIGN PATENT DOCUMENTS

| | | | |
|---|---|---|---|
| 2847701 | 5/1980 | Germany | 273/400 |

*Primary Examiner*—Mark S. Graham
*Attorney, Agent, or Firm*—William E. Noonan

[57] ABSTRACT

A collapsible pitching screen assembly is disclosed. The assembly includes an elongate container. There are a pair of elongate, spaced apart uprights collapsibly mounted within and extending upwardly from the container proximate respective ends of the container. A crossbar is detachably interconnected between respective upper portions of the uprights. There is a flexible barrier including upper and lower ends and a pair of sides that extend between the upper and lower ends. The upper end of the barrier is attached to the crossbar and each side of the barrier is attached to a respective one of the uprights such that the side is restricted from separating from the upright and the barrier is movable between a raised condition wherein the crossbar is connected between the uprights and a collapsed condition wherein the crossbar is detached from the uprights and disposed in the container.

11 Claims, 4 Drawing Sheets

COLLAPSIBLE PITCHING SCREEN ASSEMBLY

FIELD OF THE INVENTION

This invention relates to a collapsible pitching screen assembly and, more particularly, to a portable pitching screen used to protect the pitcher during baseball and softball batting practice.

BACKGROUND OF THE INVENTION

Prior to a baseball or softball game and on days between games, the players commonly take batting practice. During batting practice, the pitcher typically throws a number of pitches to each batter at a slow or medium speed. This helps the hitter warm up, prepare or otherwise improve his swing. Because the pitches are sometimes delivered at a reduced speed and from a shortened distance, skilled batters are apt to make solid contact. Batting practice pitchers are therefore particularly susceptible to being struck by hard hit line drives passing in the vicinity of the pitcher's mound. Moreover, during batting practice, the batters may take dozens, if not hundreds of swings, thereby increasing the danger to the pitcher. Each year, in youth leagues alone, thousands of players suffer injuries due to balls hit during batting practice. Pitching machines are sometimes used instead of the batting practice pitcher; however, mechanical devices generally cannot replicate the pitches delivered by a human pitcher. Additionally, such devices are expensive, require power and are not readily portable.

To protect the batting practice pitcher against injury, batting practice screens have long been available. Typically, the screen is set up in front of the mound. Following the delivery the pitcher positions himself behind the screen. As a result, he is fairly well protected against batted balls hit back "through the box" (i.e. directly at the pitcher's mound).

Most standard pitching screens are relatively large, expensive and bulky. It is fairly difficult and inconvenient to transport them between the locker or equipment room and playing field. Some screens are so large they even require wheels. For the most part, these screens are not transportable between various fields and other venues. Instead, they are usually stored permanently at one location. As a result, if a team travels to a field or other location that does not have a pitching screen, the players must take batting practice without using the protective screen. This significantly increases the risk of injury to the batting practice pitcher. Unfortunately, due to the drawbacks of conventional screens, such practice devices are rarely used by most softball and recreational baseball organizations.

SUMMARY OF INVENTION

It is therefore an object of this invention to provide a collapsible pitching screen assembly that is conveniently transportable between various locations.

It is a further object of this invention to provide a pitching screen assembly that is quick and convenient to assemble and disassemble.

It is a further object of this invention to provide a pitching screen assembly that is very stable and able to withstand the force of a solidly struck ball without toppling so as to significantly reduce the risk of injury or death to batting practice pitchers.

It is a further object of this invention to provide a pitching screen that is fairly inexpensive and suitable for use by all levels of baseball and softball players.

It is a further object of this invention to provide a pitching screen that is collapsible into an extremely compact and convenient condition so that it may be readily stored in a minimum of space and easily transported by a single individual via foot, bus, automobile, train or airplane.

This invention relates to a collapsible pitching screen assembly that includes an elongate container. There are a pair of elongate, spaced-apart uprights mounted within and extending upwardly from the container proximate respective ends thereof. Each upright includes a lower portion collapsibly mounted in the container and an upper portion detachably connected to an upper end of the lower portion. Each lower portion fits within the container when the associated upper portion is detached therefrom and the lower portion is collapsed. A crossbar is detachably interconnected between respective upper portions of the uprights. A flexible barrier includes upper and lower ends and a pair of sides that extend between the upper and lower ends. The upper end of the barrier is attached to the crossbar. Means are also provided for attaching each side of the barrier to a respective one of the uprights such that the side is restricted from separating from the upright and the barrier is movable between a raised condition wherein the crossbar is interconnected between the uprights and a collapsed condition wherein the crossbar is detached from the uprights and disposed in the container.

In a preferred embodiment, the upper portions of the uprights fit into the container when the upper portions are detached from the associated lower portions. Similarly, the crossbar fits in the container when the crossbar is detached from the uprights.

Leg means may be operably connected to and selectively extendible from the container for engaging the ground and stabilizing the assembly. The leg means may include two pairs of elongate leg elements, each pair being extendible from a respective elongate side of the container. The leg elements may be pivotally connected to the container and alternatable between extended and retracted conditions relative to the container. More particularly, the leg elements may be pivotally connected to a bottom surface of the container and alternatable between extended and retracted conditions relative to the container.

The flexible barrier may include a net having a plurality of generally vertical strands and a plurality of generally horizontal strands that cross the vertical strands. The crossbar may be threaded through the upper end of the flexible barrier. The means for collapsibly attaching may include two sets of side rings. Each set of side rings is attached to a respective side of the barrier and encircles a respective upright such that the rings and the respective side of the barrier are slidable along the uprights, for assembly and disassembly.

The lower portion of the barrier preferably extends into the container when the crossbar is interconnected between the uprights. The lower end of the barrier may be secured in place by means of a flexible harness threaded through the barrier and affixed at proximate respective ends within the container. Means may be provided for foldably mounting the lower portion of the uprights within the container. The lower portion is folded to fit within the container when the upper portion is detached from the lower portion.

A cover may be engaged with the container when the net and uprights are collapsed. A carrying strap may be attached to the container to facilitate transport of the assembly when it is collapsed and the cover is engaged.

This invention also features a collapsible pitching screen assembly having a pair of uprights that are collapsibly mounted in a container. A crossbar is detachably attached to and extends between respective upper portions of said uprights. The uprights themselves may include hinged or telescopic constructions. A net or other barrier may be engaged with the uprights and crossbar.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
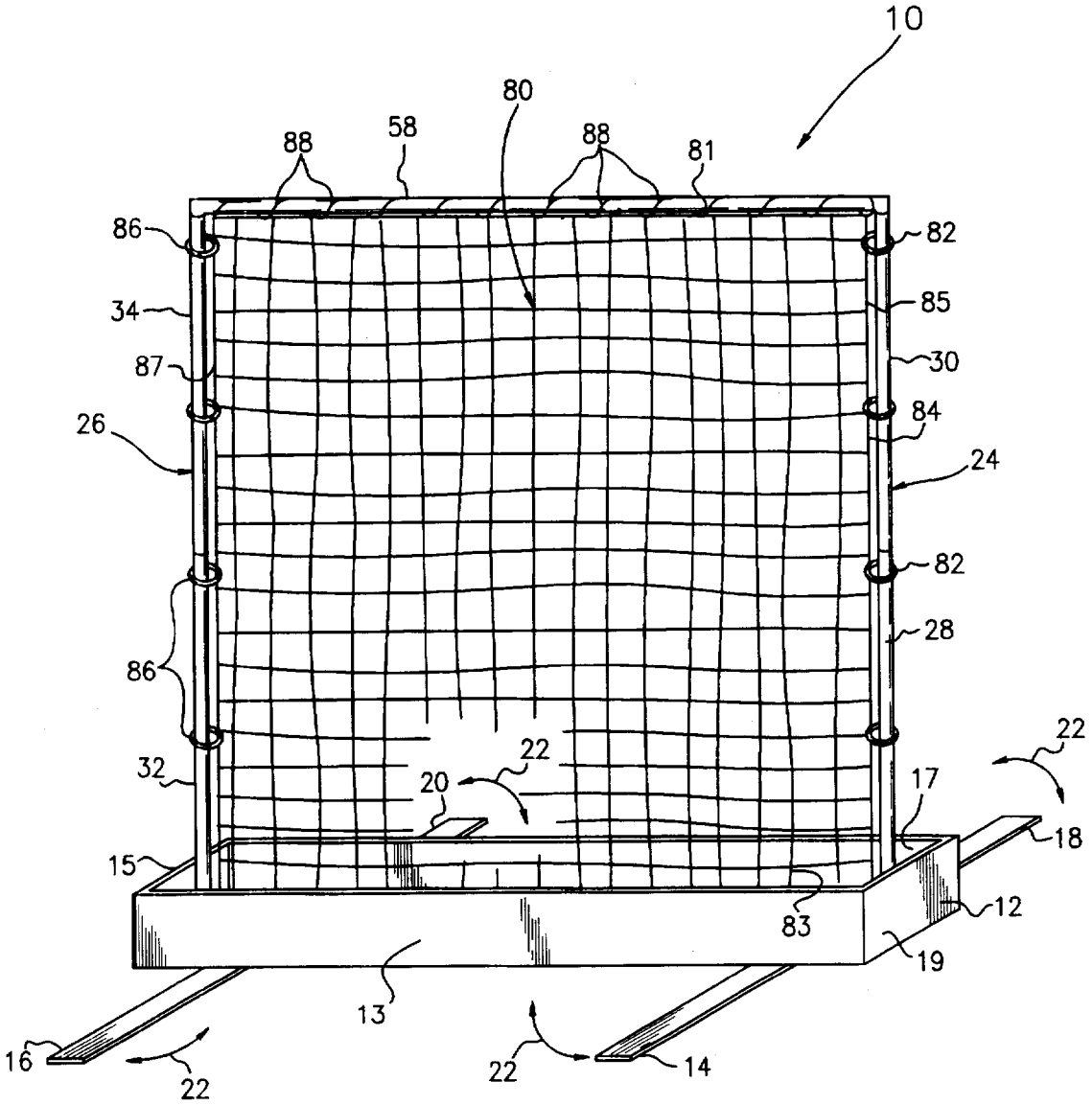
FIG. 1 is a perspective view of a preferred collapsible pitching screen assembled for use according to this invention.

There is shown in FIG. 1 a collapsible pitching screen assembly 10 specifically designed for use during baseball and softball batting practice. Assembly 10 includes an elongate container 12 having four side walls 13, 15, 17, and 19. See also FIG. 2. Container 12 also includes a floor 21, shown in FIGS. 2 and 3. In the condition illustrated in FIGS. 1 and 2, an opening is formed through the top of the container. The floor and walls of container 10 may be manufactured in a variety of ways. A preferred assembly is described below in connection with FIG. 4.

Figure 2:
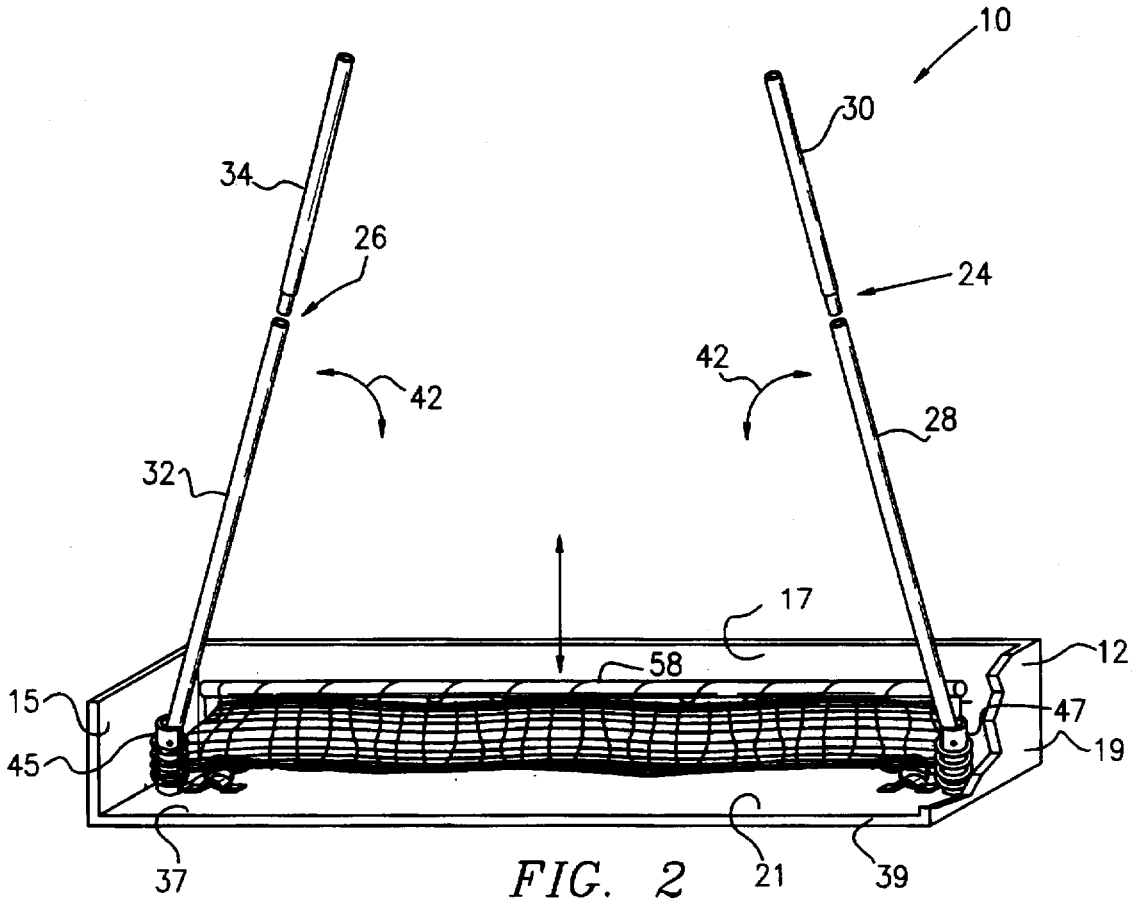
FIG. 2 is a perspective, partly cut away and partly exploded view of the pitching screen assembly with the flexible barrier in a collapsed condition.

Referring to FIG. 1, a first pair of generally flat leg elements 14 and 16 are attached to the bottom surface of floor 21 and extend forwardly from the container. A similar pair of rearward leg elements 18 and 20 are likewise attached to the bottom surface of floor 21 and extend rearwardly from container 12. Legs 14, 16, 18, and 20 are pivotally interconnected to the bottom of container floor 21 in the manner illustrated in FIG. 3. Each of the legs is secured to container 12 by a respective pivot 33. This allows the legs to pivot back and forth, as indicated by arrows 22, between an extended condition, also shown in FIG. 1, wherein the screen assembly is set up for use and a retracted condition, shown in phantom in FIG. 3, wherein the screen assembly is collapsed for transportation or storage. In FIG. 2, the legs are in the collapsed condition and thus obscured by container 12.

The container and each of the leg elements may be constructed from a variety of durable, yet lightweight materials. Various lightweight metals and metal alloys may be used. Alternatively, a wide selection of synthetic materials may compose the container. It should also be understood that although container 12 is illustrated as having a generally rectangular shape, various other elongate configurations may be employed.

As illustrated in FIGS. 1 and 2, a pair of elongate uprights 24 and 26 are attached to and extend upwardly from floor 21 of container 12. Upright 24 is located proximate container wall 19 and upright 26 is adjacent container wall 15. Right-hand upright 24 includes a lower portion 28 and an upper portion 30 that is detachably interconnected to lower portion 28. Likewise, left-hand upright 26 includes a lower portion 32 and an upper portion 34 that is detachably interconnected to lower portion 32. Upright portions 28, 30, 32 and 34 typically comprise metal or plastic segments having either a rectangular or a circular cross sectional shape. Aluminum pipe, fiberglass and various metal and plastic tubings and extrusions may be utilized.

Figure 4:
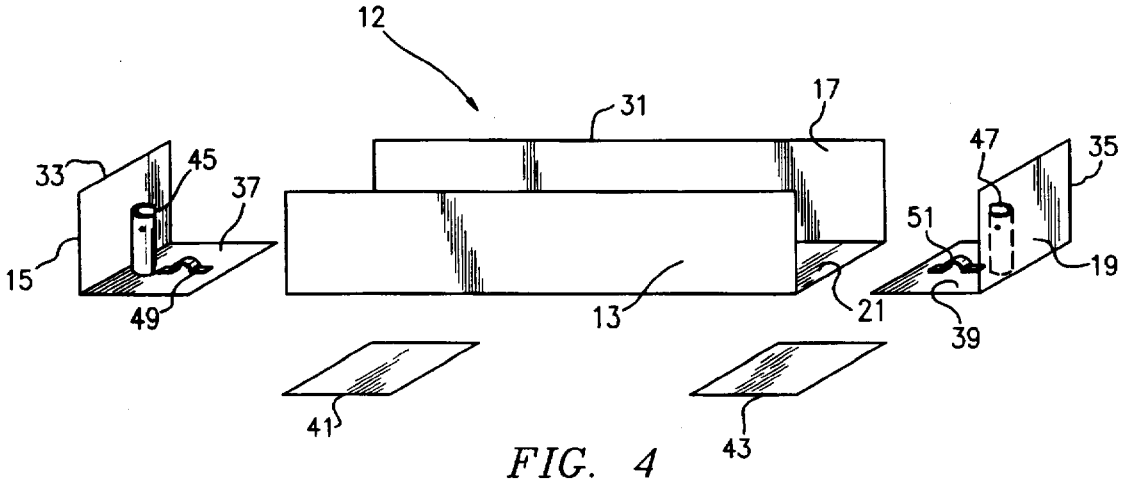
FIG. 4 is an exploded view of a preferred container.

A preferred technique for assembling container 12 is illustrated in FIG. 4. An elongate, generally U-shaped channel element 31 forms front and back sides 13 and 17, as well as floor 21. A pair of L-shaped end plates 33 and 35 are engaged with respective ends of channel element 31 to form the end walls 15 and 19. In particular, plate 33 includes a generally flat horizontal portion 37 that engages floor 21 proximate one end of channel element 31. Wall 15 comprises a substantially flat element that extends perpendicularly upwardly from portion 37. Similarly, plate 35 includes generally flat and perpendicularly interconnected portions 39 and 19. Element 39 engages the floor of element 31 proximate the opposite end of the channel element. Wall portion 19 extends upwardly from portion 39 to define the end wall of the container. Plates 33 and 35 are secured to element 31 by rivets, screws or other means. A pair of plates 41 and 43 are engaged with the bottom surface of floor 21 beneath plates 33 and 35, respectively. The screws or other attachment means that secure plates 33 and 35 to element 31 extend through and are secured to plates 41 and 43, respectively. Plates 41 and 43 may be replaced by respective washers. The leg elements, previously described, may be pivotally secured to bottom plates 41 and 43.

A generally tubular support base 45 is secured to and extends upwardly from portion 37 of plate 33. Base 45 has a generally semi-circular cross section and is secured to plate 33 by welding or other appropriate means. A similar base component 47 is attached to and extends upwardly from portion 39 of end plate 35. Bases 45 and 47 serve to pivotally support the uprights in a manner described more fully below. Clips 49 and 51 are carried by portions 37 and 39 of plates 33 and 35, respectively. A harness, described more fully below, is interconnected between clips 49 and 51. This harness serves to secure the lower end of a flexible barrier to the container. Again, this manner of construction is described more fully below.

As shown in FIG. 2, lower upright portions 28 and 32 are collapsibly mounted to the upper surface of container floor 21. As is more particularly shown in FIG. 5, lower upright portion 32 is foldably attached to a support base 45 by means of a pivot 40. As a result, upright portion 32 is permitted to fold up and down as indicated by doubleheaded arrow 42, FIG. 2, between the upright condition, shown in FIGS. 1 and 5 and a collapsed condition, wherein portion 32 is folded generally perpendicularly to base 45 and disposed within container 12. Referring again to FIG. 2, lower portion 28 is similarly attached by a pivot to the second support base 47 secured to plate position 37. As a result, lower upright section 28 is also permitted to pivot between the upright condition shown in FIG. 1 and a folded condition, wherein upright section 28 is oriented generally horizontally within container 12.

Figure 5:
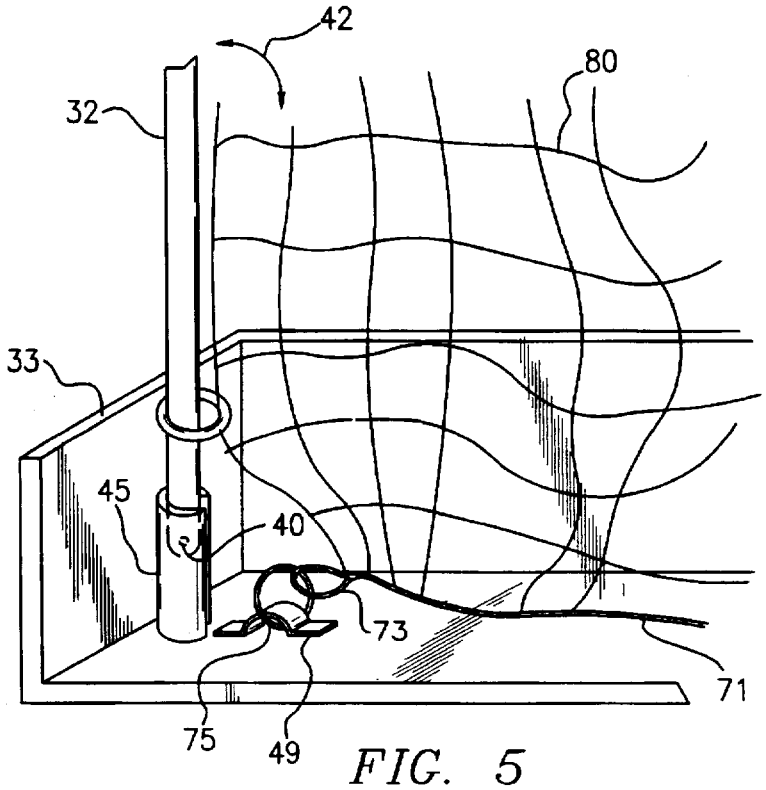
FIG. 5 is a perspective view of a representative one of the container end plates including the upright support base and the harness retaining clip carried by that plate.

It should be understood that base 47 and its attached upright section 28 are constructed and operate analogously to base 45 and upright section 32 shown in FIG. 5. They are simply formed at the opposite end of the container. The support bases 45 and 47 should be laterally offset somewhat in the container so that the uprights fold next to one another within the container. Additionally, it should be noted that the lower end of upright portion 32 (and analogously upright portion 28) is rounded in the manner illustrated in phantom in FIG. 5. This permits the upright portion to pivot freely within its respective support base from a generally vertical to a generally horizontal position. As best shown in FIG. 5, when the lower upright portion is in its vertical position, it is held upright and prevented from pivoting past vertical by the wall of the tubular support base. The tubular support base is slotted along one side only to permit the upright portion to pivot downwardly in only one direction, i.e. the direction that enables the upright portion to be collapsed within container 12.

Figure 6:
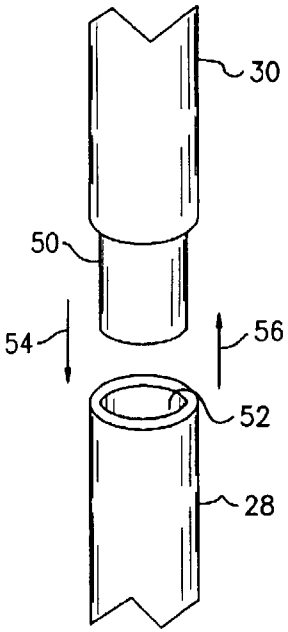
FIG. 6 is a perspective view of a preferred connection between the lower and upper portions of the upright.

FIG. 6 illustrates a representative means of interconnecting the upper and lower upright portions. Specifically, portions 28 and 30 are shown. A similar interconnection is exhibited between portions 32 and 34 of upright 26. In the depicted embodiment, the uprights comprise tubular elements, which may be composed of PVC or similar material. Upper upright portion 30 carries a reduced diameter plug 50 at its lower end. Plug 50 is snugly received within an opening 52 at the upper end of lower upright portion 28. Upper portion 30 is attached to lower portion 28 by simply inserting plug 50 into opening 52 in the direction of arrow 54. Subsequently, upper upright portion 30 is removed from the lower portion 28 by pulling the upper portion out of the lower portion in the direction of arrow 56. Upper and lower portions 32 and 34 of upright 26 are selectively engaged and disengaged in a similar manner.

Figure 7:
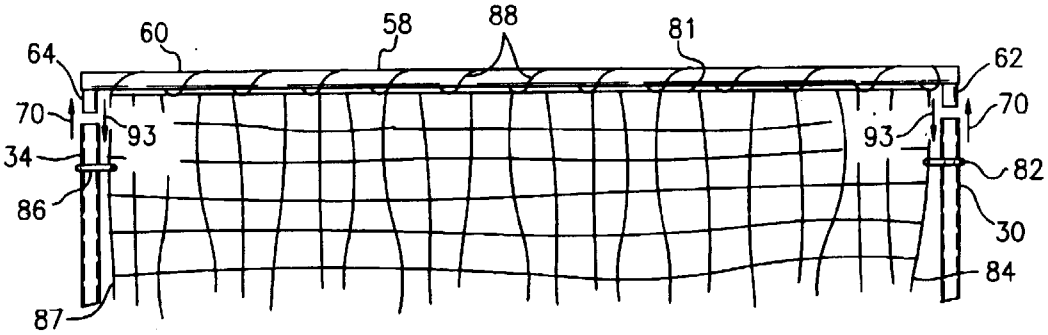
FIG. 7 is a perspective view of the crossbar and attached flexible barrier.
Figure 8:
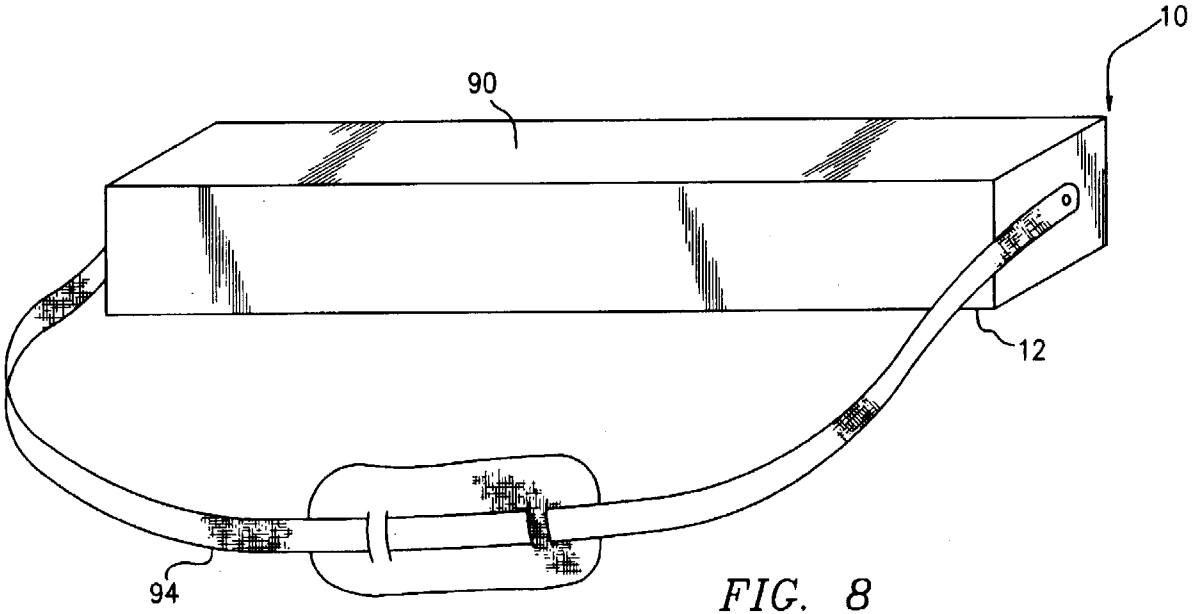
FIG. 8 is a perspective view of the pitching screen assembly in a fully collapsed condition with a cover and a carrying strap attached to the container to enable the assembly to be transported.

Referring again to FIG. 1, a crossbar 58 is detachably interconnected between the upper ends of uprights 24 and 26. Crossbar 58 comprises an elongate tubular or solid element that is similar in construction to the elements comprising the uprights. In most cases a square or cylindrical tubing or extrusion is used. As best illustrated in FIG. 7 crossbar 58 includes a generally horizontal segment 60 and a pair of segments 62 and 64 that depend from respective ends of segment 60. Depending segment 62 is received in an opening formed at the upper end of upright portion 30. Similarly, depending segment 60 is received in an opening formed at the upper end of upright portion 34. When the crossbar is engaged with the uprights in this manner, crossbar 58 is securely interconnected between uprights 24 and 26. See FIG. 1. When disassembly is required, the crossbar is removed from the uprights by simply lifting segments 62 and 64 out of upright portions 30 and 34, as indicated by arrows 70 in FIG. 7.

As best shown in FIG. 1, a flexible barrier 80 is collapsibly attached to uprights 24 and 26 and to crossbar 58. Barrier 80 features a generally rectangular shape and includes an upper end 81, a lower end 83 and sides 85 and 87. Lower end 83 extends into container 12 and is secured to container floor 21. Barrier 80 comprises a net composed of various natural and/or synthetic fibers. The net features a fairly standard construction and may be woven, sewn and otherwise constructed in a manner that will be known to those skilled in the art. The barrier may feature various mesh sizes. Alternatively, barrier 80 may comprise a solid, sheet-like composition instead of a net. The precise construction of the barrier is not a limitation of this invention.

As illustrated in FIGS. 1 and 7, net barrier 80 is attached to uprights 24 and 26 by a plurality of loop or ring elements. These elements are composed of a rugged metal or plastic. A first set of loops 82 connect side 85 of net 80 to upright 24. Each of the loops 82 wraps about a respective upright and around the peripheral seam 84 of net 80. Likewise, a second set of loops 86 connect side 87 of net 80 to upright 26. Each of the loops 86 wraps about upright 26 and peripheral seam 84 of net 80. Crossbar 58 is threaded longitudinally through an upper strand 88 of net 80. This attaches the upper end 81 of net 80 to crossbar 58 and prevents separation of the upper end of the net from the crossbar. As a result, batted balls cannot pass between the crossbar and the upper end of the net. Similarly, loops 82 and 86 restrict sides 84 and 87 from separating from uprights 24 and 26, respectively. When a batted ball hits barrier 80, the sides of the net do not separate from the uprights and the ball does not pass between the net and the uprights. This protects the batting practice pitcher from a potentially serious injury. If the loops 82 and 86 or other forms of attaching the net to the uprights or crossbar were eliminated, the net would be free to separate from the uprights. Dangerous line drives would be apt to pass through the screen. This potential problem is avoided by the present invention. It should be noted that loops, sleeves or other means may also be used to secure the top end of the barrier to the crossbar.

Barrier 80 is secured within container 12 in the manner best illustrated in FIGS. 2 and 5. A pair of clips 49 and 51 are respectively carried upon and secured to plates 33 and 35 of container 12. Each clip is disposed adjacent to one of the pivoting supports 45 and 47. In FIG. 5 the clip 49 carried by plate 33 is illustrated. An analogous construction is utilized by the clip formed on plate 35. As best shown in FIG. 5, an elongate harness 71 is threaded through the bottom end of barrier 80. A loop 73 is formed at each end of harness 71. Each loop 73 is interconnected by a ring 75 to a respective one of the clips 49, 51. In this manner, the lower end of barrier 80 is interconnected to plates 33 and 35 and thereby to container 12.

Upright engaging loops 82 and 86 also allow net 80 to be collapsed into container 12 when required. Loops 82 and 86 specifically permit net 80 to move along and collapse relative to uprights 24 and 26. This is accomplished by first disengaging crossbar 58 from the uprights. The crossbar is pulled upwardly, as indicated by arrows 70 in FIG. 6, such that depending segments 62 and 64 are pulled out of upright portions 30 and 34, respectively. The crossbar is then lowered downwardly between uprights 24 and 26. The respective sets of loops 82 and 86 simply slide along the uprights and net 80 collapses into the condition shown in FIG. 2. Crossbar 58 has a length that fits easily within container 12. As a result, net 80 and crossbar 58 are disposed within the container.

Figure 3:
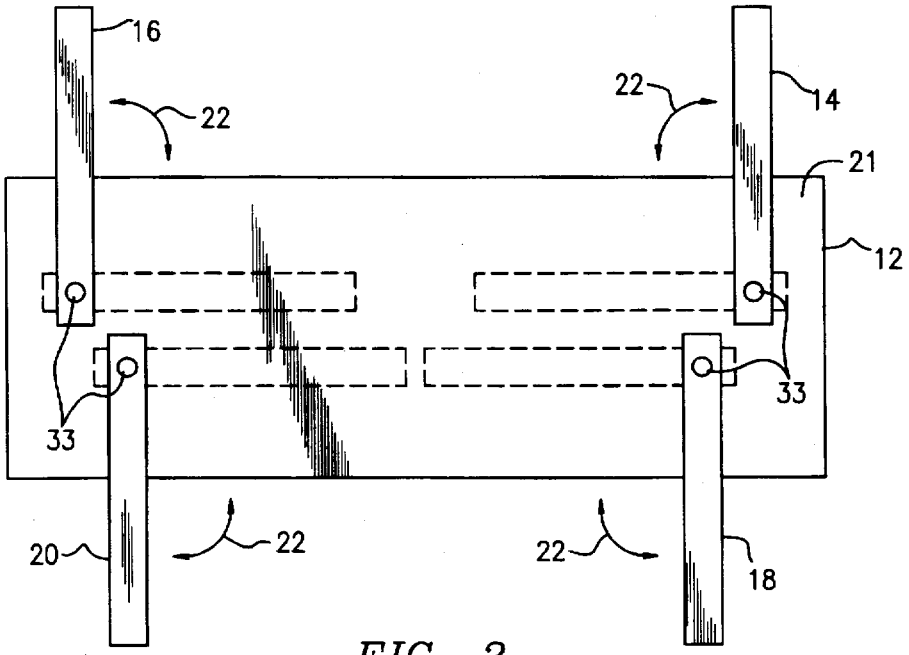
FIG. 3 is a bottom plan view of the pitching screen assembly, specifically illustrating the foldable leg elements.

After the crossbar and net have been lowered into container 12, the uprights are disassembled. Specifically, upright portions 30 and 34 are removed from upright portions 28 and 32, respectively. The pivotally mounted upright portions 28 and 32 are then folded down into container 12. Again, each of portions 28 and 32 is short enough to fit within container 12 in the folded condition. Next, upright portions 30 and 34 are placed within the container. These upright portions too have a length that enables them to fit within container 12. Finally, legs 14, 16, 18 and 20, which are extended while assembly 10 is being used, as shown in FIGS. 1 and 3, are folded into the collapsed condition shown in phantom in FIG. 3. As a result, the pitching screen assembly is fully collapsed and all working components are received within the container. A cover 90, FIG. 7, is then engaged with container 12. This cover may be secured closed by appropriate means, not shown. Assembly 10 is now fully contained and ready for transport. A strap 94 may be used to transport assembly 10 to its next desired location.

To set up assembly 10 for operation, the above-described procedure is simply reversed. Container 12 is placed on the ground such that floor 21 is disposed directly above the ground. Legs 14, 16, 18 and 20 are pivoted outwardly into the position shown in FIGS. 1 and 3. Cover 90 is opened and upright sections 28 and 32 are pivoted into the upright condition. Upright sections 30 and 34 are then removed and interengaged with sections 28 and 32, respectively, such that the uprights are fully constructed. The assembler then grasps crossbar 58 and raises it together with the attached net 80 along fully constructed uprights 24 and 26. Loops 82 and 86 slide along the respective uprights. When the crossbar reaches the upper end of the uprights it is interengaged with the uprights in the manner shown in FIG. 7. Specifically, depending segments 62 and 64 are inserted in the direction of arrows 93, into upright portions 30 and 34, respectively. The pitching screen assembly is now fully erected and ready for use. Batted balls and line drives hit back at the screen are safely intercepted so that injury to the batting practice pitcher is avoided. The legs are sufficiently broad and long that they stably support the entire assembly and prevent the assembly from tipping over even under the force of a solidly hit ball. After batting practice is completed, assembly 10 is disassembled in the manner previously described.

It should be noted that other structural variations may be employed by assembly 10 within the scope of this invention. For example, each upright portion may be composed of one piece or multiple interconnected segments. Those upright segments may be detachably interconnected as shown herein. Alternatively, they may be foldably or telescopically joined. Instead of being pivotally supported in the container, as shown herein, the upright may be removably received in respective receptacles fixed within the container. In certain embodiments, the entire upright may be composed of a single unitary segment. However, it is preferred that the upright be broken down into at least an upper and lower portion. This is because the erected upright should be tall enough to protect the warm up pitcher's head. This means that it should be at least 6 feet high. On the other hand, the container, which acts as a carrying case, should not be longer than about several feet. Otherwise, it will be too bulky and inconvenient to transport. An upright that is constructed in a single piece will likely have to be at least 6 feet in length. For that reason, it is preferred that each upright include upper and lower portions that can be disassembled, or otherwise collapsed, and stored in the container in the manner described herein.

Accordingly, this invention provides a number of benefits. The pitching screen is quick and convenient to erect and to disassemble. When it is collapsed, the assembly is lightweight, compact and convenient to both store and transport. Because of its small size, it can be transported easily on airplanes and in motor vehicles. The sturdy and stable construction of the pitching screen provides improved protection for the warm-up pitcher and is suitable for use by players, teams and leagues at all levels of competition.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A collapsible pitching screen assembly comprising:

an elongate container;

a pair of elongate, spaced apart uprights mounted within and extending upwardly from said container proximate respective ends of said container, each upright including a lower portion collapsibly mounted in said container and an upper portion detachably connected to an upper end of said lower portion, each said lower portion fitting within said container when said associated upper portion is detached therefrom and said lower portion is collapsed;

a crossbar that is detachably interconnected between the respective upper portions of said uprights and which fits in said container when said crossbar is detached from said uprights;

a flexible barrier including upper and lower ends and a pair of sides that extend between said barrier upper and lower ends, said upper end of said barrier being attached to said crossbar;

means for collapsibly attaching each said side of said barrier to a respective one of said uprights such that said side is restricted from separating from said upright and said barrier is movable between a raised condition wherein said crossbar is interconnected between said uprights and a collapsed condition wherein said crossbar is detached from said uprights and disposed in said container; and leg means operably connected to and selectively extendible from said container for engaging the ground and stabilizing said assembly.

2. The assembly of claim 1 in which said upper portions of said uprights fit in said container when said upper portions are detached from said associated lower portions.

3. The assembly of claim 1 in which said leg means include two pairs of elongate leg elements, each said pair being extendible from a respective elongate side of said container.

4. The assembly of claim 1 in which said leg elements are pivotally connected to said container and alternatable between extended and retracted conditions relative to said container.

5. The assembly of claim 3 in which said leg elements are pivotally connected to a bottom surface of said container and alternatable between extended and retracted conditions relative to said container.

6. The assembly of claim 1 in which said flexible barrier includes a net having a plurality of generally vertical strands and a plurality of generally horizontal strands that cross said vertical strands.

7. The assembly of claim 1 in which said crossbar is threaded through said upper end of said flexible barrier.

8. The assembly of claim 1 in which said means for collapsibly attaching include two sets of side rings, each said set of side rings being attached to a respective said side of said barrier and encircling a respective said upright such that said rings and said respective sides of said barrier are slidable along said uprights at least when said crossbar is detached from said uprights.

9. The assembly of claim 1 in which said lower end of said barrier extends into said container when said crossbar is interconnected between said uprights.

10. The assembly of claim 1 further including means for foldably mounting said lower portions within said container, said lower portions being folded to fit within said container when said upper portion is detached therefrom.

11. A collapsible pitching screen assembly comprising:

an elongate container;

a pair of elongate, spaced-apart uprights collapsibly mounted in and extending upwardly from said container proximate respective ends of said container;

a crossbar that is detachably interconnected between respective upper portions of said uprights and which fits in said container when said crossbar is detached from said uprights;

a flexible barrier including upper and lower ends and a pair of sides that extend between said upper and lower ends;

means for attaching said upper end of said barrier to said crossbar;

means for collapsibly attaching each said side of said barrier to a respective one of said uprights such that said side is restricted from separating from said upright and said barrier is movable between a raised condition wherein said crossbar is interconnected between said uprights and a collapsed condition wherein said crossbar is detached from said uprights and disposed in said container; and leg means operably connected to and selectively extendible from said container for engaging the ground and stabilizing said assembly.

* * * * *